United States Patent [19]

Hayama et al.

[11] Patent Number: 5,060,567

[45] Date of Patent: Oct. 29, 1991

[54] ROTARY STENCIL PRINTER WITH PRINTING DRUM OF NET CYLINDRICAL BODY RADIALLY OUTWARDLY EXPANDABLE IN FULL CIRCUMFERENCE

[75] Inventors: Noboru Hayama; Yoshiharu Ohinata, both of Tokyo, Japan

[73] Assignee: Riso Kagaku Corporation, Tokyo, Japan

[21] Appl. No.: 626,831

[22] Filed: Dec. 13, 1990

[30] Foreign Application Priority Data

Dec. 26, 1989 [JP] Japan ..... 1-341020

[51] Int. Cl.[5] ..... B41L 13/00

[52] U.S. Cl. ..... 101/120; 101/127.1

[58] Field of Search ..... 101/116, 117, 118, 119, 101/120, 127, 127.1, 128; 118/406

[56] References Cited

U.S. PATENT DOCUMENTS

| | | | |
|---|---|---|---|
| 2,906,201 | 9/1959 | Blair | 101/120 |
| 3,232,224 | 2/1966 | Kramer | 101/120 |
| 4,856,428 | 8/1989 | Green et al. | 101/116 |
| 4,911,069 | 3/1990 | Hayama et al. | 101/120 |

FOREIGN PATENT DOCUMENTS

| | | | |
|---|---|---|---|
| 89987 | 6/1982 | Japan | 101/119 |
| 178285 | 10/1984 | Japan | 101/116 |
| 2225078 | 9/1990 | Japan . | |

*Primary Examiner*—Edgar S. Burr

*Assistant Examiner*—Ren Yan

*Attorney, Agent, or Firm*—Stevens, Davis, Miller & Mosher

[57] ABSTRACT

In a rotary stencil printer having a printing drum made of two annular members connected by a transverse bar member and a net member of woven, non-woven or knitted fibers of a rectangular shape in development wound around the two annular members with opposite side edge belt portions thereof being slidably laid on outer circumferential surfaces of the annular members so as to form a porous cylindrical body for mounting a stencil sheet as wound therearound, a back press roller of a diameter common with the printing drum disposed to face an outside surface of the printing drum so as to define a print sheet nip region with the printing drum therebetween and having a groove in an outside surface portion thereof adapted to receive the transverse bar member therein in meeting therewith in synchronized rotations of the printing drum and the back press roller in opposite directions, and an inner press roller disposed in an inside space of the printing drum so as to contact with an inside surface of the porous cylindrical body along a generatrix thereof, the transverse bar member is spaced radially outwardly from a cylindrical outer configuration of the porous cylindrical body at a portion thereof facing the porous cylindrical body so that the inner press roller can traverse a portion facing the transverse bar member with no collision therewith.

5 Claims, 3 Drawing Sheets

ROTARY STENCIL PRINTER WITH PRINTING DRUM OF NET CYLINDRICAL BODY RADIALLY OUTWARDLY EXPANDABLE IN FULL CIRCUMFERENCE

Background of the Invention

1. Field of the Invention

The present invention relates to a technical art of stencil printing, and more particularly, to a rotary stencil printer.

2. Description of the Prior Art

A rotary stencil printer is known as a type of stencil printing device in such a construction that it comprises a printing drum having a perforated cylindrical surface for feeding ink therethrough and adapted to bear a perforated stencil sheet mounted therearound while it is supported to be rotatable about a central axis thereof, and a back press roller arranged to be rotatable about a central axis thereof disposed in parallel with said central axis of said printing drum with a cylindrical peripheral outer surface thereof facing the peripheral outer surface of said printing drum so as to define a nip region therebetween for nipping and transporting a print sheet therethrough.

The printing drum in the rotary stencil printer of this type was conventionally constructed from a metal plate formed with a number of openings punched out therethrough and bent into a cylindrical configuration, the wall thickness of such a cylindrical body being designed to be large enough to ensure the strength and the rigidity of the whole construction of the printing drum.

It has been proposed by Japanese Patent Application 63-28553 (Laid-open publication 1-204781) filed by the applicant same as the assignee of the present invention to construct the cylindrical wall portion having the ink feeding openings of the printing drum substantially only by a net material in which fibers are woven or knitted, as a substitute for the above-mentioned conventional construction of the printing drum of a rotary stencil printer, so that such a cylindrical wall portion made of substantially only a net material is adapted to be pressed radially outwardly by an inner press roller contacting therewith at a radially inside surface thereof. The particular functions and effects of the printing drum having such a perforated cylindrical wall portion substantially made of only a net material available by as compared with the conventional printing drum of the rigid cylindrical wall are described in detail in the above-mentioned laid-open publication.

Further, in order to meet with a problem that in the printing drum according to said prior proposal, when a net material made of woven or non-woven fibers is extended between a pair of annular members with opposite side edge portions thereof being fixed to said annular members, such a cylindrical construction is liable to twisting due to an inherent low rigidity thereof against twisting, thereby causing a wrinkling in a stencil sheet wound therearound, resulting in a distortion of a printed figure, it has been proposed by Japanese Patent Application 1-47029 filed by the applicant same as the assignee of the present invention to lay opposite side edge portions of a net material of a rectangular shape in development extended between two annular members on the circumferential surfaces of the annular members in a freely slidable state as not fixed to the annular members.

When the printing drum is so constructed that the net material of a rectangular shape in development is mounted around the annular members with the opposite side edge portions thereof being freely slidable relative to the annular members, even if a relative angular displacement occurs between the two annular members, such as angular displacement is absorbed by a sliding movement between the net material and the circumferential surface of the annular member with no twisting being cause in the net material, so that an improved stencil printing is available with exclusion of deformations of the printed figure due to a twisting of the printing drum. Further, since the net material works in no twisting state in such a construction, not only a net material made of woven or knitted fibers but also a net material made of non woven fibers are employable.

In the conventional rotary stencil printer it was necessary to reciprocate a roller member having a relatively large mass quickly in one and opposite directions perpendicular to its rotation axis in synchronization with the rotation of a printing drum every time when the printing drum makes one rotation all through the operation of the printer. In more detail, the printing drum is provided with a stencil sheet fastening means at a part of its cylindrical outer surface portion along a generatrix thereof for holding a leading edge portion of a stencil sheet of a rectangular shape in development mounted around the printing drum, such a stencil sheet leading edge fastening means projecting radially outwardly from the cylindrical outer configuration of the printing drum. Therefore, in the rotary stencil printer having the conventional rigid printing drum made of a metal plate formed with ink feeding openings the back press roller which presses a print sheet to be applied with printing thereon against the cylindrical outer surface of the printing drum must have been temporarily retracted away from the printing drum every time when the stencil sheet leading edge fastening means traverses a position to face it so that a collision thereof with the stencil sheet leading edge fastening means is avoided. Since such a temporary retraction of the back press roller away from the printing drum needs to be done without losing the function of the back press roller that it presses the printing sheet onto the cylindrical outer surface of the printing drum, it is required that the back press roller is retracted away from the printing drum at a moment when the stencil sheet leading edge fastening means approaches very closely to the back press roller and is quickly returned to its normally forwarded position just after the stencil sheet leading edge fastening means has traversed the position to face it, thereby requiring high acceleration in the reciprocating movement of the back press roller, thus leading to high probability of strong percussive vibration and/or noise being generated in the whole construction of the printer.

In the rotary stencil printers proposed by the above-mentioned Japanese Patent Applications 63-28553 and 1-47029 a function such as pressing a print sheet onto a stencil sheet which is mounted around the printing drum and is supplied with ink from the inside surface thereof is obtained by such a mechanism that an inner press roller mounted in the inside space of the cylindrical body of the printing drum constructed by a net material expands a part of the cylindrical body radially outwardly toward the back press roller, instead of the back press roller being forwarded toward the printing drum. In this construction, if the back press roller is constructed to have the same diameter as the printing drum with a groove being formed at a part thereof so as to be able to receive therein the stencil sheet leading edge fastening means of the printing drum in meeting therewith, when the printing drum and the back press roller are rotated in synchronization with one another so that the stencil sheet leading edge fastening means of the printing drum just meets with said groove of the back press roller every time when they face one another, it is not necessary to retract the back press roller away from the printing drum for the purpose of avoiding the collision between the stencil sheet leading edge fastening means and the back press roller even at a time when the stencil sheet leading edge fastening means traverses the position to face the back press roller. In this connection, such a trouble that the back press roller is contaminated with ink by the back press roller coming into direct contact with the printing drum when no print sheet is supplied to be therebetween can be avoided by introducing in such a control that the radial pushing out of the inner press roller is allowed according to a detection on whether or not a print sheet is supplied to a nip region between the printing drum and the back press roller. Therefore, also from this point of view it is not necessary to control the position of the axis of the back press roller for any movement, thereby completely obviating the probability of generation of vibration or noise due to a transverse movement of the back press roller.

However, even in this construction, since the transverse bar member extended between the two annular members and supporting the stencil sheet leading edge fastening means is constructed to have an inside face aligned with the cylindrical outer configuration of the printing drum made of a net material, if the inner press roller for expanding the cylindrical body made of the net material radially outwardly from its inside in the printing operation is kept in its radially outwardly shifted state even when the transverse bar member traverses the position of the inner press roller, there occurs an undesirable collision between the inner press roller and the transverse bar member. Therefore, it is still required that the inner press roller is temporarily retracted away from the printing drum so that such a collision thereof with the transverse bar member is avoided when the transverse bar member traverses the position facing the inner press roller. Since such a retraction of the inner press roller and a return thereof after the passing of the transverse bar member must also be done at high acceleration as in the above-mentioned reciprocation of the back press roller, there still remains a problem that certain vibration and/or noise due to such a movement of the axis of the inner press roller may occur, though such a problem is less serious because the inner press roller is much light weighted than the back press roller.

SUMMARY OF THE INVENTION

It is the object of the present invention to solve such problems as mentioned above concerned with the generation of vibration and/or noise due to the movement of the axis of the back press roller or the inner press roller so as thereby to provide an improved rotary stencil printer in which those problems are obviated.

According to the present invention the above-mentioned object is accomplished by a rotary stencil printer comprising a printing drum including two annular members of a common diameter, a transverse bar member extending between said two annular members and having a stencil sheet fastening means for fastening a leading edge portion of a stencil sheet, and a net member of woven, non-woven or knitted fibers of a rectangular shape in development, said net member being wound around said two annular members with opposite side edge belt portions thereof in said rectangular shape of development being slidably laid on outer circumferential surfaces of said annular members so as to form a porous cylindrical body for mounting said stencil sheet as wound therearound; a back press roller of a diameter common with said printing drum disposed to face an outside surface of said printing drum so as to define a print sheet nip region with said printing drum therebetween; and an inner press roller disposed in an inside space of said printing drum so as to contact with an inside surface of said porous cylindrical body along a generatrix thereof, said back press roller having a groove in an outside surface portion thereof adapted to receive said transverse bar member therein in meeting therewith, said printing drum and said back press roller being adapted to be rotated in synchronization with one another in opposite directions relative to one another so that said transverse bar member is aligned with said groove in meeting together, wherein said transverse bar member is spaced radially outwardly from a cylindrical outer configuration of said porous cylindrical body at a portion thereof facing said porous cylindrical body.

By constructing the transverse bar member extended between the two annular members to support the stencil sheet leading edge fastening means thereon to be radially outwardly spaced from the cylindrical configuration of the net member expanded between the two annular members, the transverse bar member can traverse a position facing the inner press roller while the inner press roller is being maintained in the state of pressing the cylindrical net member radially outwardly, as the printing drum rotates, with no collision with the inner press roller. Thus, the movement of the axis of the inner press roller for avoiding the collision with the tranverse bar member is no longer required.

Therefore, in the rotary stencil printer according to the present invention the inner press roller may be continually maintained at the forward position for pressing the printing drum made of the net member radially outwardly during a series of printing processes in which print sheets are successively supplied to the nip region, and the control for the movement of the axis of the inner press roller between said forward position and a retracted position shifted radially inwardly therefrom may be made only in accordance with whether or not a print sheet is supplied to a certain determinate printing position, or in other words, only in order to avoid that the back press roller is contaminated with ink by coming into direct contact with the printing drum.

Further, if the control for the movement of the axis of the inner press roller is now required only for avoiding the contamination of the back press roller with ink due to its direct contact with the printing drum in the absence of print sheet therebetween, such a control for the movement of the axis of the inner press roller may be replaced by a control for the movement of the axis of the back press roller, or a control for promptly braking the rotation of both the printing drum and the back press roller upon detection of the absence of print sheet at a determinate position may be employed while cancelling all control with respect to the movement of the axes of the back press roller and the inner press roller.

In the rotary stencil printer according to the present invention said transverse bar member may be a strip member having a relatively small thickness mounted at opposite ends thereof to said annular members by way of stay pieces.

Further, in the rotary stencil printer according to the present invention said net member may be fastened to said transverse bar member at a leading edge portion thereof of said rectangular shape in development with a trailing edge portion thereof of said rectangular shape in development being extended beyond a portion thereof facing a radially inside surface of said transverse bar member. In such an embodiment, said net member may be elastically expanded in a circumferential direction along said outer circumferential surfaces of said annular members by a portion thereof close to said trailing end portion thereof being spring-biased toward said transverse bar member.

Alternatively, in a rotary stencil printer according to the present invention, said net member may be fastened to said annular members at a leading edge portion thereof of said rectangular shape in development by way of a leaf spring with a trailing edge portion thereof of said rectangular shape in development being extended to be sandwiched between said leading edge portion thereof and said outer circumferential surfaces of said annular members.

BRIEF DESCRIPTION OF THE DRAWINGS

In the accompanying drawings.

DESCRIPTION OF THE PREFERRED EMBODIMENTS

Figure 3:
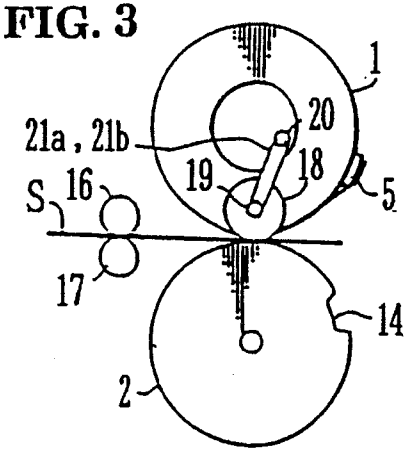
FIGS. 1–3 are side views showing diagrammatically an essential portion of the structure of a rotary stencil printer according to the present invention in three different operating states.

In the following the present invention will be described in more detail with respect to the preferred embodiments thereof with reference to the accompanying drawings.

Referring to FIGS. 1–4, 1 and 2 designate a printing drum and a back press roller, respectively. The printing drum 1 comprises annular members 3*a* and 3*b* forming opposite end portions thereof, and a net member 4 of a rectangular shape in development formed into a cylindrical body with belt regions along opposite side edges thereof being slidably laid on the circumgerential outer surfaces of the annular member 3*a* and 3*b* as described in more detail hereinunder, wherein the net member may be a woven, non-woven or knitted net material such as, for example, a net having warps and wefts of stainless wires. A transverse bar member 5 is provided to extend along a generatrix of the printing drum, and a stencil sheet leading edge fastening means 5*a* is provided on the transverse bar member 5 for selectively fastening a leading edge portion of a stencil sheet mounted around the printing drum. The transverse bar member operates as a means for connecting the annular members 3*a* and 3*b*. However, since the annular members 3*a* and 3*b* are respectively driven in synchronization with one another as described hereinunder, no substantial strength is required for the transverse bar member. The printing drum 1 is supported to be rotatable about its central axis by annular stub portions 6*a* and 6*b* projecting oppositely outwardly from the annular members 3*a* and 3*b* being rotatably received in bearing means 7*a* and 7*b* supported in a frame 8. The back press roller 2 is supported to be rotatable about its central axis by stub portions 9*a* and 9*b* projecting oppositely outwardly therefrom being rotatably received in bearing means 10*a* and 10*b* supported in the frame 8.

Figure 2:
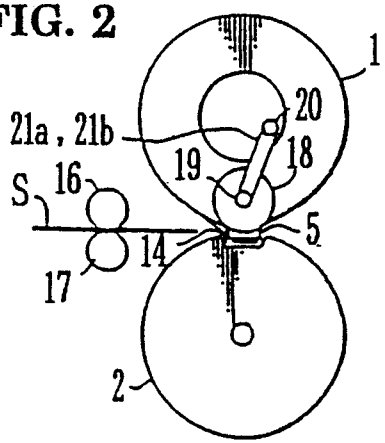
Figure 1:
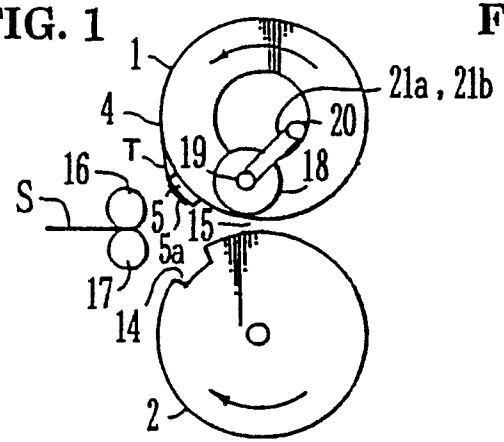
Figure 4:
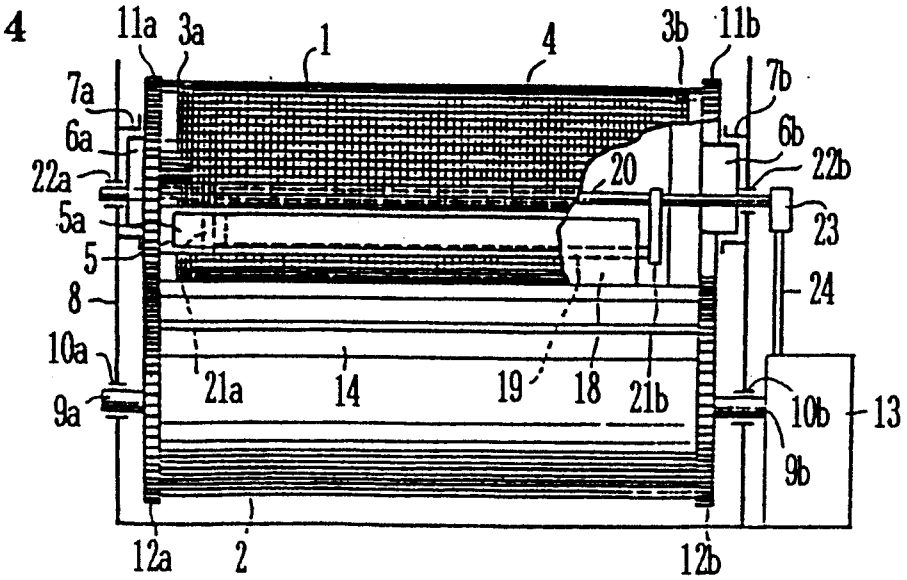
FIG. 4 is side view partly in a diagrammatical illustration of a rotary stencil printer incorporating the structure shown in FIGS. 1–3.

The printing drum 1 and the back press roller 2 are adapted to rotate in directions opposite to one another as shown by arrows in FIGS. 1–2 by annular gears 11*a* and 11*b* provided at opposite axial ends of the printing drum being in meshing engagement with similar annular gears 12*a* and 12*b* provided at opposite axial ends of the back press roller 2, such rotations being motivated by the shaft 9*b* of the back press roller being driven by a driving unit 13 including an electric motor therein. Since the back press roll 2 may be constructed to have a rigid structure, a twist-free angular synchronization between the annular members 3*a* and 3*b* can be ensured by way of the back press roller 2 even when the transverse bar member 5 is not so strong. The back press roller 2 is formed with a groove 14 which can receive the transverse bar member 5 therein when they meet with one another.

In FIGS. 1–4 the clearance between the outside surfaces of the printing drum 1 and the back press roller 2, or in other words, the increase of the distance between the central axes of the printing drum 1 and the back press roller 2 from the sum of the radii thereof is exaggerated relative to the magnitude of the diameters thereof for the purpose of illustration. In fact, said clearance or said increase in the distance between the two central axes is so small as in the order of 2–5 mm in an actual device in which the printing drum has a diameter such as ten and several centimetres. This clearance provides a nip region 15 for nip a print sheet S therein so as to apply a printing thereon. The print sheet S is transported toward the nip region 15 by feed rollers 16 and 17.

An inner press roller 18 is provided in the inside space of the printing drum 1 for selectively pressing such a portion of the cylindrical body made of substantially only the net member 4 that extends along a generatrix thereof facing the back press roller 2 radially outwardly toward the back press roller 2 so that it is bulged out of the originally cylindrical configuration. The inner press roller 18 is supported by a shaft 19 extending along a central axis thereof to be rotatable thereabout, said shaft 19 being supported at its opposite ends by arms 21*a* and 21*b* which in turn are supported by a shaft 20 extending through the printing drum 1 across the annular stub portions 6*a* and 6*b* and rotatably received at its opposite end portions in bearing means 22*a* and 22*b* mounted in the frame 8. On end of the shaft 20 is connected with the driving unit 13 via a lever 23 and a link 24 so as to be driven thereby in accordance with signals from such sensors not shown in the figure as detecting if a stencil sheet is mounted around the printing drum 1 in a determinate state and if a print sheet is supplied to the nip region 15 in a determinate state, so that the inner press roller 18 presses a generatrix portion of the cylindrical net body facing the back press roller 2 radially out toward the back press roller 2. FIGS. 2 and 3 show the states of the cylindrical net body with such a generatrix portion being bulged out by the inner press roller 18 toward the back press roller 2, wherein in the state shown in FIG. 2 the transverse bar member 5 is just received in the groove 14 and the stencil sheet T mounted around the printing drum 1 with its leading edge being fastened to the transverse bar member 5 is just going to contact with a print sheet S.

Since a leading edge portion and a trailing edge portion of a stencil sheet mounted around the printing drum with said trailing edge portion being positioned adjacent said leading edge portion are generally not perforated, it will not cause contamination with ink of the back press roller even if the cylindrical body made of the net material is bulged out by the inner press roller so as to be pressed against the back press roller when the leading and trailing edge portions are facing the inner press roller. Further, since there exists the transverse bar member 5 at a portion extending between the leading and trailing edge portions of the stencil sheet mounted around the printing drum while the back press roller 2 is spaced from the transverse bar member 5 in its portion of the groove 14, it does not occur that the back press roller is contaminated with ink even when the cylindrical body made of the net material is bulged radially outwardly toward the inner face of the transverse bar member by the inner press roller 18 in the state shown in FIG. 2.

Although it is not shown in the figures, the ink is introduced into the inside space of the printing drum in the same manner as in the conventional rotary stencil printer so as to be supplied to the outer surface of the inner press roller 18 in the form of a layer and then to be transferred from the outer surface of the inner press roller to the inside surface of the cylindrical body made of the net member so that it is supplied to the stencil sheet from the inside surface thereof. Therefore, the inner press roller 18 operates not only as a press roller for pressing out a portion of the cylindrical net body of the printing drum toward the back press roller but also as an ink supply roller. Therefore, the inner press roller in this structure is comparable in its functions with the hand roller used with the primitive stencil printer which had a rectangular frame supporting a net member, wherein the hand roller operated as a means for pressing a stencil sheet attached on the net member to a print sheet as well as a means for supplying ink to the stencil sheet.

Figure 5:
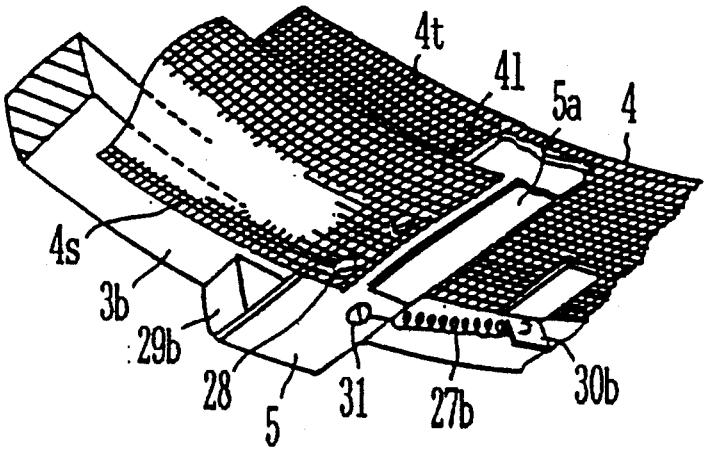
FIG. 5 is a perspective view of a part of the printing drum showing the essential portion of improvement with respect to the printing drum according to the present invention.
Figure 8:
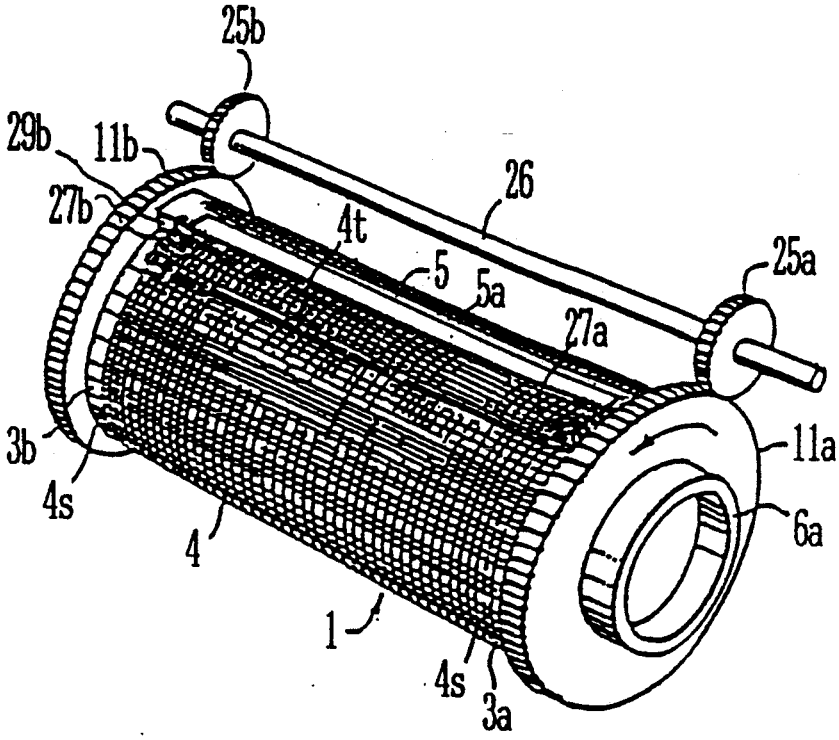
FIG. 8 is a perspective view of the printing drum showing another construction for accomplishing the synchronized rotation of the two annular members forming the opposite ends of the printing drum.

The particular improvement of the rotary stencil printer according to the present invention resides in that the transverse bar member 5 is spaced radially outwardly from the cylindrical configuration of the cylindrical body made of the net member 4, i.e. the cylindrical shape enveloping the circumferential outer surfaces of the annular members 3*a* and 3*b*. The structure of this essential portion is shown in FIG. 5 in the form of a partial perspective view which is a view of a lower end portion of the printing drum in the state shown in FIG. 2 taken from a position near the annular member 3*b* with the transverse bar member 5 being at its lowest position. A leading edge portion 41 of the net member 4 of a rectangular shape in development is fastened to the transverse bar member 5 by appropriate fastening means such as screws 28 while its opposite side edge belt portions 4*s* are slidably laid on the circumferential outer surfaces of the annular members so far as fully to encircle them with its trailing edge portion 4*t* being spring-biased by a tension coil spring 27*b* (another tension coil spring 27*a* at another end, as shown in FIG. 8) by way of a metal piece 30*b* in a direction of tightening the net member around the annular members. In the shown embodiment one end each of the springs 27*a* and 27*b* are mounted to opposite end portions of the transverse bar member 5 by appropriate fastening means such as screw 31.

The transverse bar member 5 may be a strip member having a relatively small thickness as in the shown embodiment mounted at opposite ends to the annular members 3*a* and 3*b* by way of pieces 29*a* and 29*b* (only 29*b* is shown in FIG. 5) so that it is substantially spaced from the cylindrical outer configuration of the annular members 3*a* and 3*b* and the cylindrical body made of the net member 4.

Figure 6:
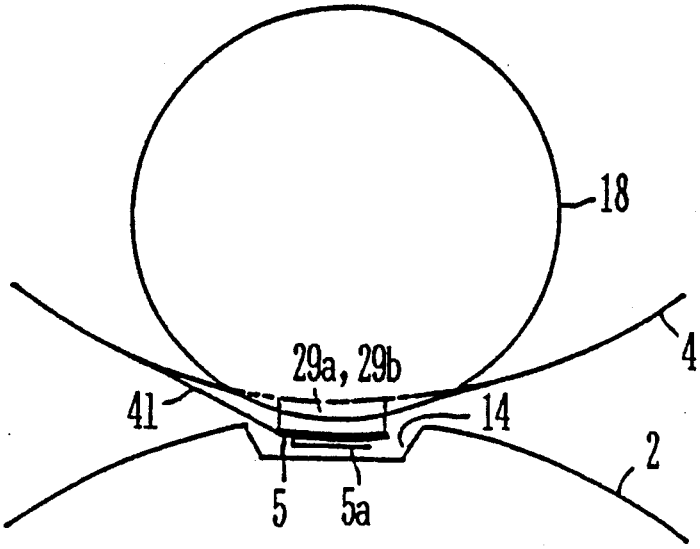
FIG. 6 is a diagrammatical view showing the state of the transverse bar member passing below the inner press roller in the rotary stencil printer according to the present invention.

FIG. 6 is a diagrammatical illustration of the relative configurations of the various members in the mounting construction of the transverse bar member 5 to the annular members as shown in FIG. 5 in the state wherein the transverse bar member is received in the groove 14 of the back press roller 2, corresponding to an enlargement of the essential portion in FIG. 2. From this figure it will be understood that the printing drum 1 can rotate so as to let the transverse bar member 5 pass below the inner press roller 18 with no problem while the inner press roller is continually pressing a generatrix portion of the cylindrical body made of the net member 4 radially outwardly therefrom.

Figure 7:
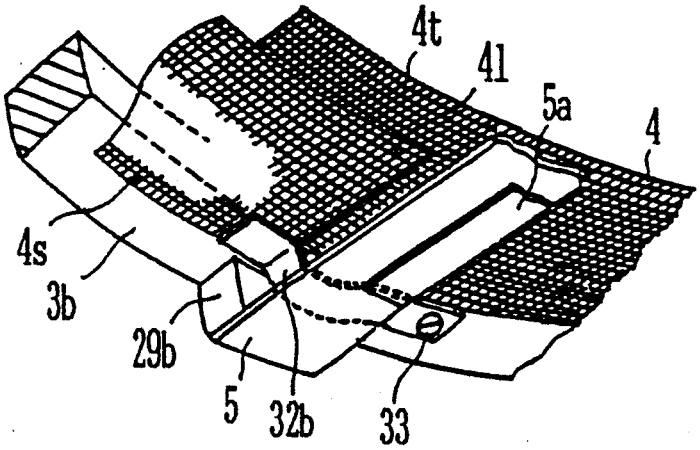
FIG. 7 is a view similar to FIG. 5 showing another embodiment of the essential portion of the present invention.

FIG. 7 is a view similar to FIG. 5 showing another embodiment of the structure for fastening the leading edge portion 41 of the net member 4 to the annular members 3*a* and 3*b*. In this embodiment the net member 4 is fastened to the annular members 3*a* and 3*b* at its opposite side edge portions near its leading edge by way of leaf springs 32*a* and 32*b* (only 32*b* is shown in FIG. 7). The leaf spring 32*b* is fastened to the net member 4 at one end thereof by soldering or other appropriate binding means and is fastened at the other end thereof to the annular member 3*b* by an appropriate fastening means such as screw 33. The leaf spring has an arcuate shape as shown in the figure so as to provide the leading edge of the net member with a support elastic in the circumferential direction of the cylindrical body. Further, in this embodiment the trailing edge portion 4*t* of the net member is left free as only sandwiched between the leading edge portion thereof and the circumferential surfaces of the annular members 3*a* and 3*b*. Since the net material is applied with a squeezing action from the leading edge thereof toward the trailing edge thereof in accordance with the rotation of the printing drum, the net material will be maintained in a desirably expanded condition having no wrinkling even when the trailing edge portion is left free as described above.

FIG. 8 is a perspective view of the printing drum incorporating still another embodiment for driving the two annular members 3*a* and 3*b* in synchronization with one another so that no twisting should occur therein. In this embodiment, pinions 25*a* and 25*b* connected with one another by a shaft 26 are meshed with the annular gears 11*a* and 11*b* provided in the annular members 3*a* and 3*b*, respectively, thus ensuring twist-free synchronized driving of the annular members 3*a* and 3*b*. In this embodiment, the annular gear 12*a* provided at one end of the back press roller 2 is of course not required.

Also in the rotary stencil printer according to the present invention, as in those proposed by Japanese Applications 63-28553 and 1-47029, the printing drum having the ink feeding portion made of substantially only a net material can readily and directly supply the ink introduced into the inside space thereof to the whole area of a stencil sheet mounted therearound through a thin layer of the net material, so that, when a new printing process is started with a new stencil sheet being mounted around the printing drum, the first print sheet can be supplied with an amount of ink enough to produce a clear image, thus obviating the loss of initial trial printing.

Further, since no such means are required as to change the distance between the axes of the printing drum 1 and the back press roller 2 in synchronization with the rotation of the printing drum, while the movement of the inner press roller 18 between the state shown in FIGS. 1 and the state shown in FIG. 2 or 3 can be attained by a small turn of a relatively simple driving structure such as the shaft 20 in the shown embodiment for a small movement of a relatively light weighted inner press roller 18, such operations can be done with no substantial generation of noise.

Further, since the inner press roller 18 may be maintained in the forwarded state while the transverse bar member 5 is traversing thereunder, when print sheets are supplied in succession to obtain a large number of prints, the printing process may proceed with the inner press roller 18 being maintained in the forwarded position, thereby completely obviating generation of vibration or noise.

Thus, as described above, according to the present invention, when a plurality of prints are continually produced the printing process is continually carried on with both the back press roller and the inner press roller being stationarily maintained with respect to their axes, so that the operation noise of the rotary stencil printer is substantially reduced.

Although the Invention has been described with respect to some preferred embodiments thereof, it will be understood by those skilled in the art that various modifications are possible with respect to the shown embodiments without departing from the spirit of the present invention.

We claim:

1. A rotary stencil printer comprising a printing drum including two annular members of a common diameter, a transverse bar member extending between said two annular members and having a stencil sheet fastening means for fastening a leading edge portion of a stencil sheet, and a net member of woven, non-woven or knitted fibers of a rectangular shape in development, said net member being wound completely around said two annular members with opposite side edge portions thereof in said rectangular shape of development being slidably laid on outer circumferential surfaces of said annular members so as to form a porous cylindrical body for mounting said stencil sheet as wound therearound; a back press roller of a diameter common with said printing drum disposed to face an outside surface of said printing drum so as to define a print sheet nip region with said printing drum therebetween; and an inner press roller disposed in an inside space of said printing drum so as to contact with an inside surface of said porous cylindrical body along a generatrix thereof, said back press roller having a groove in an outside surface portion thereof adapted to receive said transverse bar member therein in meeting therewith, means rotating said printing drum and said back press roller in synchronization with one another and in opposite directions relative to one another so that said transverse bar member is aligned with said groove when both said transverse bar member and said groove net at said nip region said transverse bar member having at a portion thereof facing said porous cylindrical body said portion being spaced radially outward from said porous cylindrical body.

2. A rotary stencil printer according to claim 1, wherein said transverse bar member is a strip member having a relatively small thickness mounted at opposite ends thereof to said annular members by way of stay pieces.

3. A rotary stencil printer according to claim 1, wherein said net member is fastened to said transverse bar member at a leading edge portion thereof said rectangular shape in development with a trailing edge portion thereof of said rectangular shape in development being extended beyond a portion thereof facing said portion of said transverse bar member which faces said porous cylindrical body.

4. A rotary stencil printer according to claim 3, wherein said net member is elastically expanded in a circumferential direction along said outer circumferential surfaces of said annular members by a portion thereof close to said trailing end portion thereof being spring-based toward said transverse bar member.

5. A rotary stencil printer according to claim 1, wherein said net member is fastened to said annular members at a leading edge portion thereof of said rectangular shape in development by way of a leaf spring with a trailing edge portion thereof of said rectangular shape in development being extended to be sandwiched between said leading edge portion thereof and said outer circumferential surfaces of said annular members.

* * * * *